US010537759B2

(12) United States Patent
Medina

(10) Patent No.: US 10,537,759 B2
(45) Date of Patent: Jan. 21, 2020

(54) MULTI TFI WITH FLUID SPRINKLERS

(71) Applicant: Juan Manuel Medina, Tijuana (MX)

(72) Inventor: Juan Manuel Medina, Tijuana (MX)

(73) Assignee: Juan Manuel Medina, Tijuana B.C. (MX)

( * ) Notice: Subject to any disclaimer, the term of this patent is extended or adjusted under 35 U.S.C. 154(b) by 0 days.

(21) Appl. No.: 15/731,537

(22) Filed: Jun. 26, 2017

(65) Prior Publication Data

US 2017/0296850 A1 Oct. 19, 2017

Related U.S. Application Data

(60) Provisional application No. 62/495,623, filed on Sep. 20, 2016, provisional application No. 61/619,896, filed on Apr. 3, 2012.

(51) Int. Cl.

| | |
|---|---|
| ***A62C 3/02*** | (2006.01) |
| ***A62C 2/06*** | (2006.01) |
| ***A62C 99/00*** | (2010.01) |
| *B66F 9/18* | (2006.01) |

(52) U.S. Cl.

CPC ..... *A62C 3/0257* (2013.01); *A62C 2/06* (2013.01); *A62C 99/0027* (2013.01); *B66F 9/18* (2013.01)

(58) Field of Classification Search

CPC ..... A62C 3/0257; A62C 3/0264; A62C 27/00; A62C 99/0009; A62C 99/0018; A62C 99/0027; A62C 2/06–248; A62C 31/24; B60R 2021/0079; B66C 23/701–708; B66C 23/64; B66C 23/702; B66C 23/706; B66C 23/823; B66F 9/12; B66F 9/061; B66F 9/07563; B66F 9/18

USPC ..... 169/52, 62, 48–50, 70; 414/685, 686, 414/705, 711; 187/203–221; 239/172

See application file for complete search history.

(56) References Cited

U.S. PATENT DOCUMENTS 3,788,492 A * 1/1974 Kraft ..... B66C 23/708 212/180
5,113,948 A * 5/1992 Richardson ..... A62C 3/06 169/49
5,211,245 A * 5/1993 Relyea ..... A62C 27/00 169/24

(Continued)

*Primary Examiner* — Christopher S Kim
*Assistant Examiner* — Juan C Barrera

(57) ABSTRACT

A fire extinguisher apparatus that consists on a loading lever network that gets built in the transport equipment allowing manipulation of the device that is directly introduced to the fire to compress it and by this, stopping the combustion process. Simultaneously, the said extinguishing apparatus will inject a series of substances over the flames, drastically reducing temperature of the fire zone, avoiding reignition when the device collapses on the different interventions these have.

Figure 1:
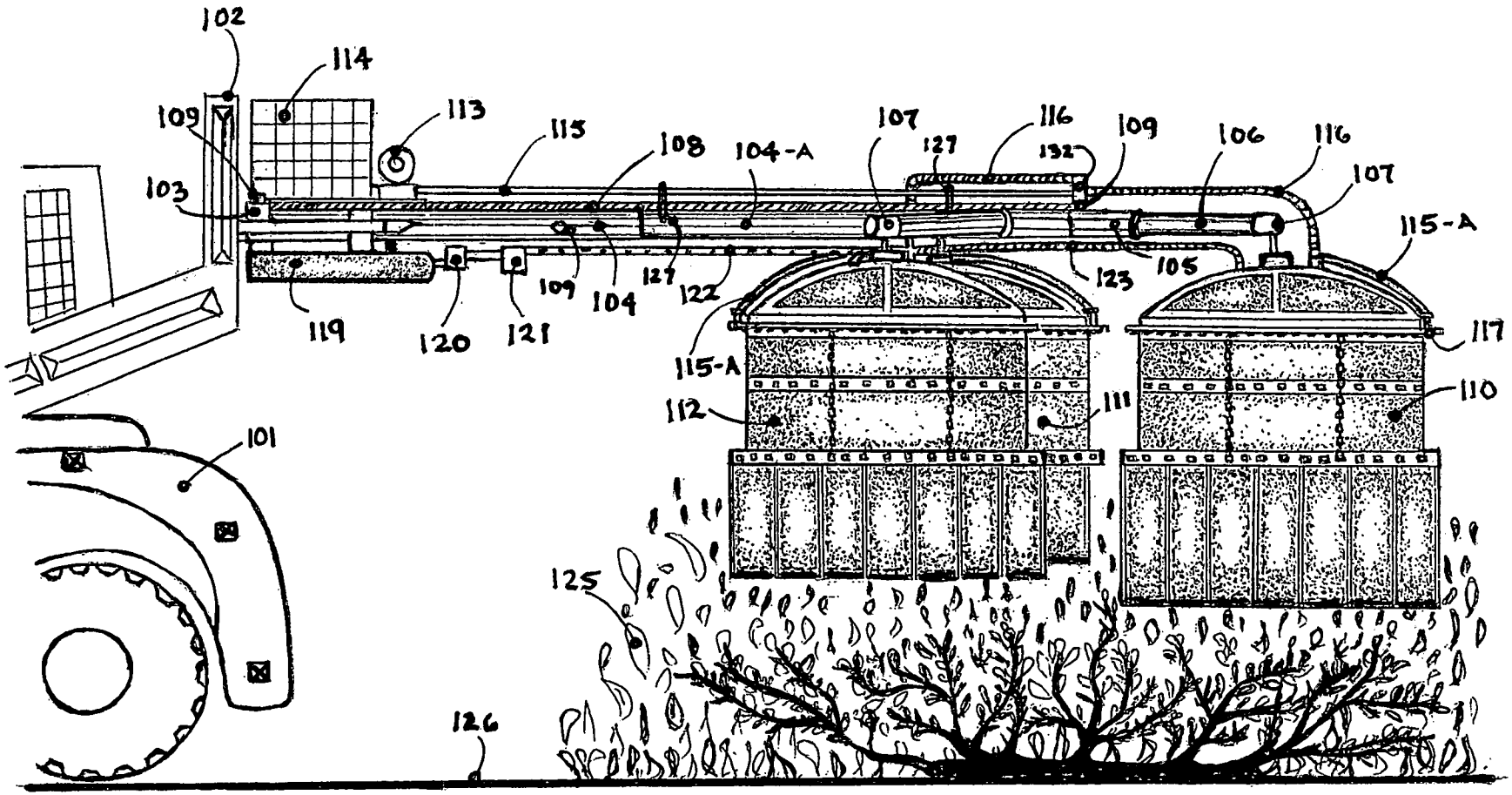

The Main Lever of such network is originally built in to the transport equipment and one end will branch different tips which will form a net of smaller lever which will hang the TFI device. A tension cable will go across the upper part of the Main lever to bring more resistance and provide much more strength by preventing arcing of the lever when handling very heavy loads. A pipeline network that extends and is supported over and through the lever network, transports the cooling substances from the fluid deposits until the injecting sprinklers are arranged in the upper part of the attack devices.

2 Claims, 9 Drawing Sheets

(56) References Cited

U.S. PATENT DOCUMENTS

2009/0139736 A1* 6/2009 Medina ..... A62C 2/06
169/54

* cited by examiner 108
130
131
105
103
101
131
130
109
129
104
127
109
104-A
109
127
129
107
109
101
109
101
109
101

MULTI TFI WITH FLUID SPRINKLERS

CROSS-REFERENCE TO RELATED APPLICATIONS

This application claims benefit of provisional Patent Ser. No. 62/495,623 Filed Sep. 20, 2016 by the present inventor.

This application is related to application Ser. No. 61/619,896 filed Apr. 3, 2012 now U.S. Pat. No. 9,174,074 B2, granted Nov. 3, 2015.

FEDERALLY SPONSORED RESEARCH

Not Applicable

SEQUENCE LISTING OR PROGRAM

Not Applicable

BACKGROUND

Filed of Invention

This invention relates and is aimed at extinguishing fire combining the action of compressing the flames with the use and support of the detachable lever and making a substance injection to neutralize and eliminate fire, as well as avoiding reignition.

Prior Art

For over a hundred years, it has been impressive to see how different forms, methods and technologies have been applied, to find an effective solution to solve the forest fire issue. We must take into consideration that a great number of designs and equipment have been fabricated in the past, destined to overcome the effects and damages forest fires generate. Till this day and as expected, some systems and processes as well as equipments, have proven to be more effective than others. Unfortunately the results of these equipments have shown to be ineffective, leaving the issue unsolved.

The effort made by scientists, businessman and government from different countries do not cease investing a great amount of time and economic resources to find a balanced solution, since some systems and equipment are highly expensive, others are polluting the environment or result to be dangerous when implemented and without obtaining effective results.

This new invention, "Multi TFI with fluid Sprinklers", combines one procedure and two fundamental actions. The procedure consists on assembling a lever to carry the TFI device which will be joined over the manipulation and loading equipment (telehandlers and tractors). This assembling procedure will be done in a simple matter by two people without using tools of any kind. Likewise, the two actions that are applied once the loading lever installed over the equipment, will be to compress the flames and to inject modified substances over these. This makes it a very innovative invention, since with the compaction of the flames with the TFI Injector, the combustion process will rest, injecting the necessary amount of substances to eliminate the fire. Also, with this second action a fire reignition is avoided, since the area that is treated with this procedure reduces high temperatures, because of the effects caused by the fluid injection from the sprinklers located in the interior and exterior of the TFI device.

The main motivation creating this invention is that a series of materials and retardants can be discharged and injected in short distance from the fire, because the TFI dispositive, with the jet and sprinklers system is directly introduced in the affected area, which makes it a very efficient and innovative system. The fluids that are injected are minimum quantities, so the fluid containers have a higher efficiency and this represents that with less quantity of substances a bigger affected area can be attacked, so the content of these deposits becomes more efficient and this is extremely valuable, since these materials that are injected are of vital importance when attacking and containing the fire in remote places. Another novelty of this invention is that the leverage, manipulation and loading structure form a bridge between the fluid deposit and the TFI disposals, therefore the already mentioned fluid discharges are directly ejected in short distance from the flames. So in every attack of the fire zone, the productivity in these machines is very high.

If we take into account the above, it follows that this invention "Multi TFI with Sprinklers" is totally new and unique.

Here are some of the previously patented technologies described as prior art:

The technology presented by the "Toxic Fume Injector" (TFI), U.S. Pat. No. 9,174,074 B2, shows that is very efficient to eliminate fire when it encapsulates and compresses, sealing the oxygen entry to the dispositive interior, by which the combustion process stops, because the oxygen gets eliminated in the process. This technology is very efficient on fires in which the size of the device is larger than the flames that are being attacked. Therefore, there is a point where if the fire is bigger than the TFI device, fire tends to re initiate in several occasions. For which a bigger TFI device must be fabricated, only to attack fires of medium intensity, which will not be as convenient, since functionally, it does not result very adequate, because there will be restrictions when transporting the device.

Combustion Process Stopper CPS U.S. Pat. No. 8,118,108 consists of an airtight flexible chamber, although the function thereof among other things is to form a seal with the ground where it is deposited and avoids the inclusion of oxygen into the chamber, and the combustion process stops the fire by lack of oxygen. The results are obtained very slowly and you have to wait until the fire consumes all the oxygen that was caught previously in the sealed chamber of the device. And although it manages to extinguish the fire, the size of the tree or bush that is on fire should perfectly enclose or covered by the CPS device.

This practice is not always presented as the sizes and shapes of trees and shrubs vary widely, which sometimes does not allow the device Combustion Process Stopper CPS, to cover the entire area of the fire to attack and that may allow for more oxygen to flow to the inside from the outside of the chamber and can permit the combustion process to remain active.

There is also the technology by U.S. Pat. No. 3,687,185 by Isadore Singer. This invention relates to a set of curtains that are packaged and deployed vertically downward it is intended to prevent the spread of fire to a specific area that is bounded by these curtains.

Although these curtains form a sort of shield against fires that wants to enter the area protected by them, the problem is that generates an airtight way as the roof is fully open and the connection between them allows oxygen flow in both directions and not forming a sealing joint between curtain and curtain. Another problem created by this invention is that it only defines and protects a certain area and cannot be used in other affected areas, so it is a system or set of curtains for a single fire.

Technology by M. A. Freedman presented in U.S. Pat. No. 3,209,837, and whose invention consists of fabric rolls that are placed horizontally and contain therein powder retardant chemicals. These can be thrown on the fire once it is activated by a device that allows a vertical fall by gravity and rolls of cloth wrapper in chemicals expel these powders on the fire. However, the dust will fall upon only the area delimited by these cabinets containing there rolls and chemical containers, once the system is activated by temperature or manually. Another limitation presented by this invention is that it can be used only once, to reuse the system, it must be recharged and placed back in its original position. Time spent on reuse is quite considerable.

The invention U.S. Pat. No. 5,331,956 submitted by Mickey M. Bailey is a blanket or sheet that is manually removed from the back of a seat in aircrafts, and that protects the passenger from the fire that might occur in aircraft. However, this system is very limited as each seat uses a blanket or sheet and becomes of fully personal use, and may not be used in other areas of fire fighting; the system blocks the fire from outside to protect the body by the blanket. The system does not generate a sealed chamber when activated, allowing the flow of oxygen to the interior and does not extinguish the fire so that it only protects from the fire.

Technology by Robert Karvonen presented in U.S. Pat. No. 4,964,780 A, And whose invention consists on a telescopic loading element, and although to form an element that elongates and contracts, a chain mechanism system would be necessary as well as a hydraulic system and only whit its design and fabrication will have one reestablished measuring length. In addition, the system is fixed on a mounted mobile unit, for which the loading element cannot be used in any other manipulator or conveyor. Likewise, although this element has a great capacity, its unbearable to get near the heat since the hydraulic hoses and the actuator system would collapse due to the intensity of the heat.

The invention U.S. Pat. No. 3,840,128 A Swoboda J, Swoboda N. This technology, although somehow portable and able to install in different transport unities and in different places on the terrain, it's a loading element that is very limited when it comes to its stretching versatility, since the size will always have a maximum that will not exceed. Another, limitation presented by this invention is that to transfer from one point to another, which there could be a possibility of using another lever, due to its weight.

Also, to disassemble and transfer from one point to another, it would take more time and will represent a big challenge to assemble.

DRAWINGS_FIGURES

FIG. 1 Side view of the TFI set carried by handling equipment

Figure 2:
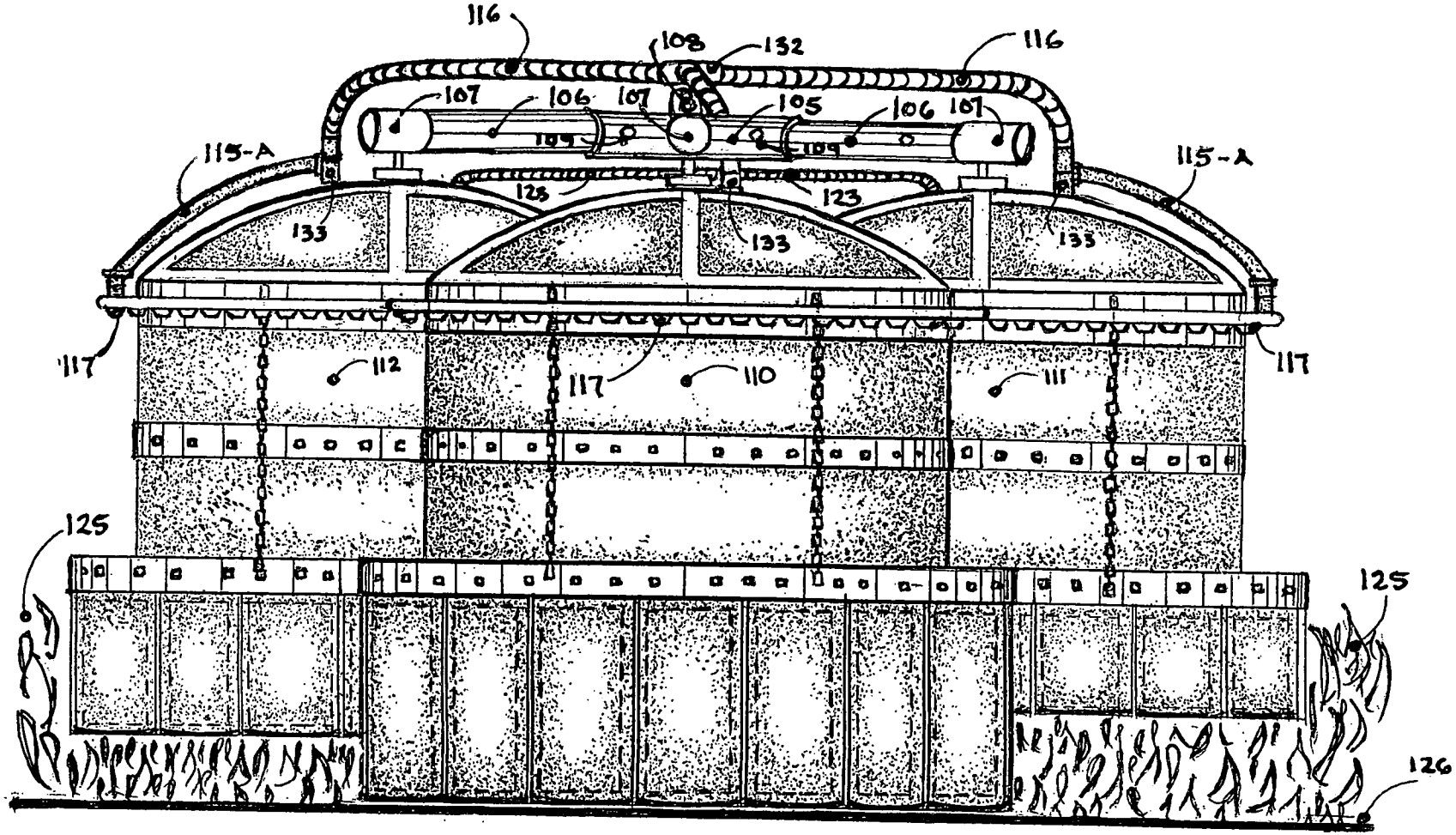

FIG. 2 Front view of the TFI set

Figure 3:
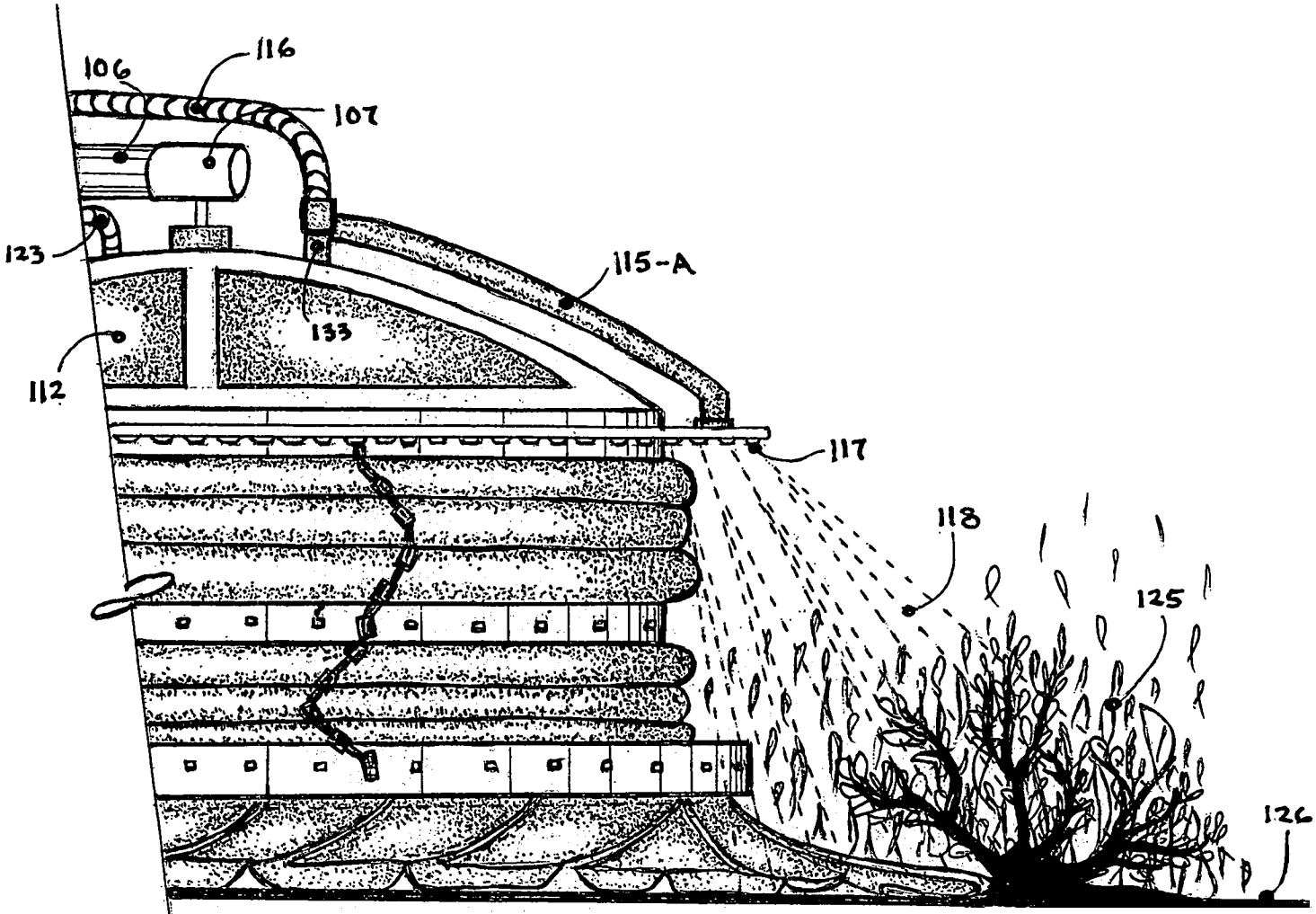

FIG. 3 Side view of TFI with activated fluid sprinklers

Figure 4:
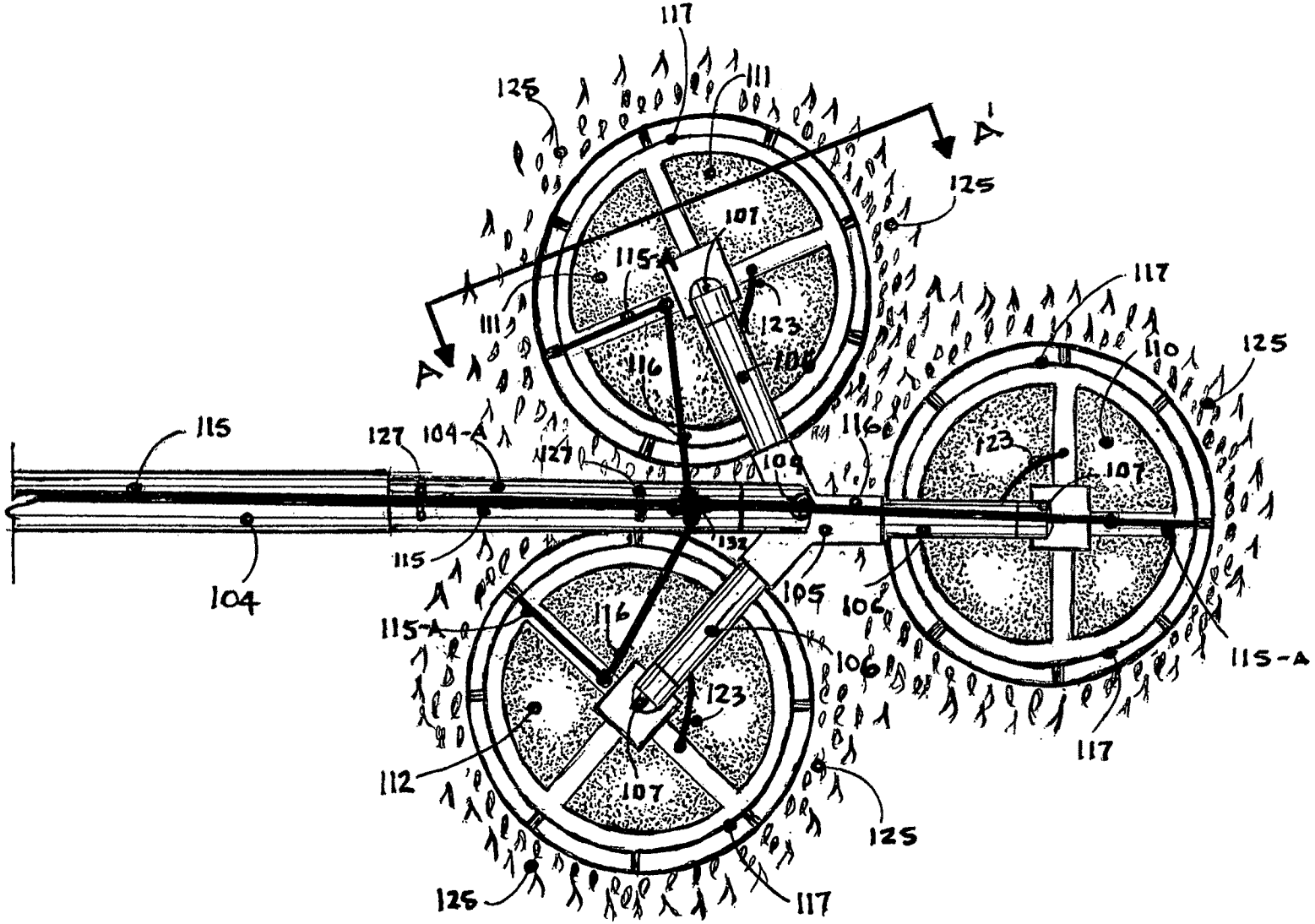

FIG. 4 Top view of the TFI set before attacking the fire zone

Figure 5:
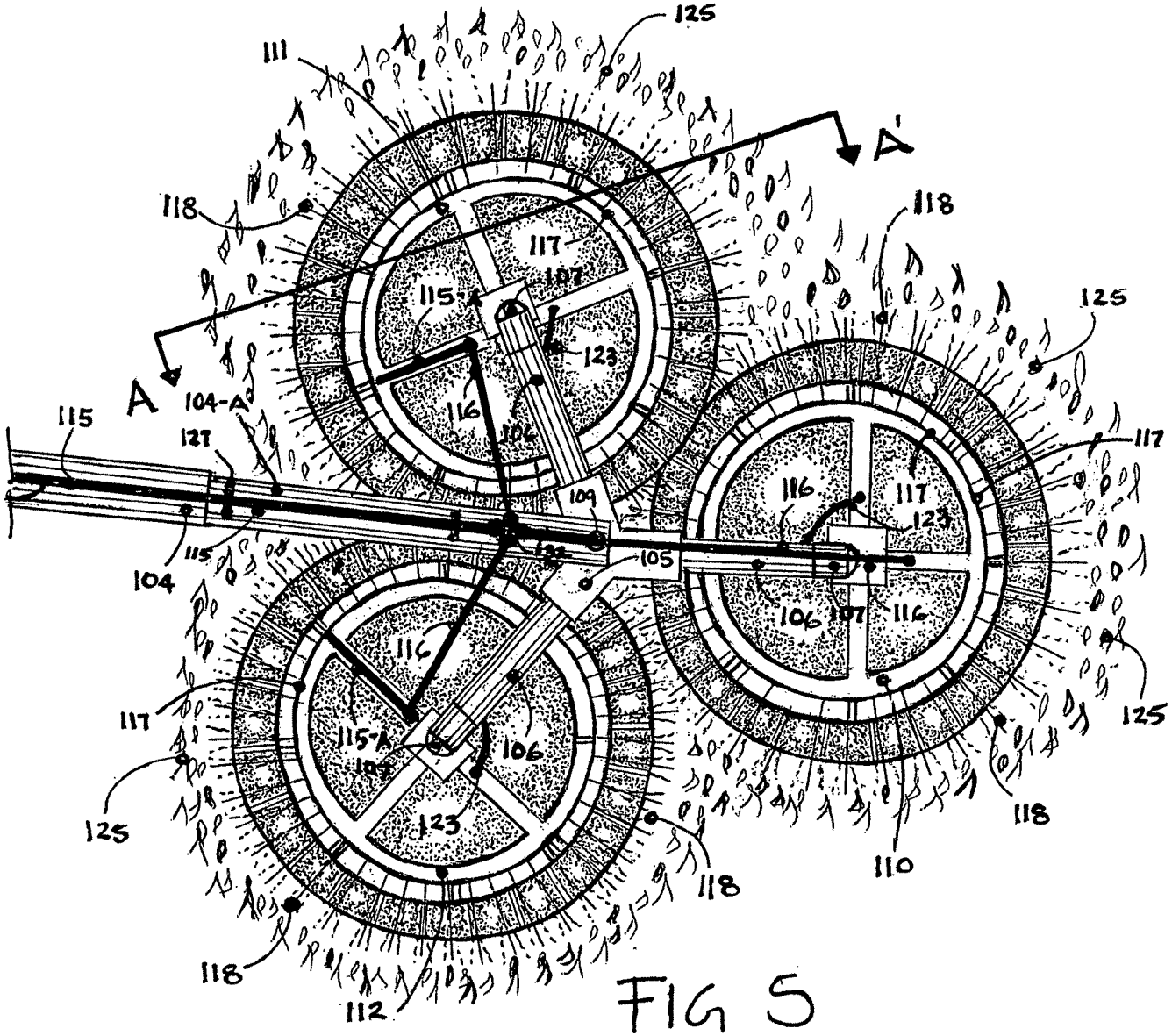
Figure 6:
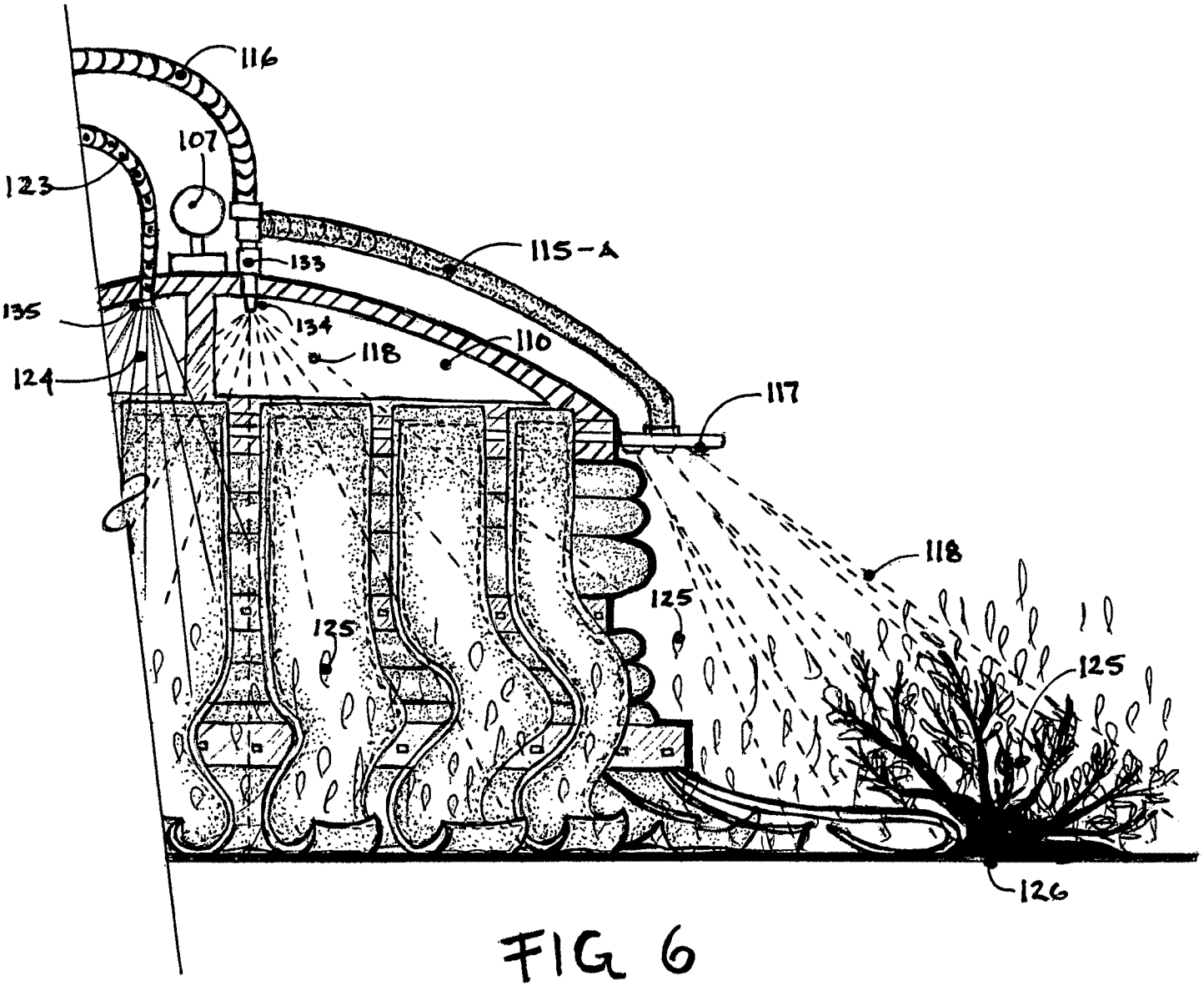

FIG. 5 Top view of the TFI set attacking the fire zone with activated fluid sprinklers FIG. 6 Interior view of TFI with activated fluid sprinklers and CO2 (A-A')

Figure 7:
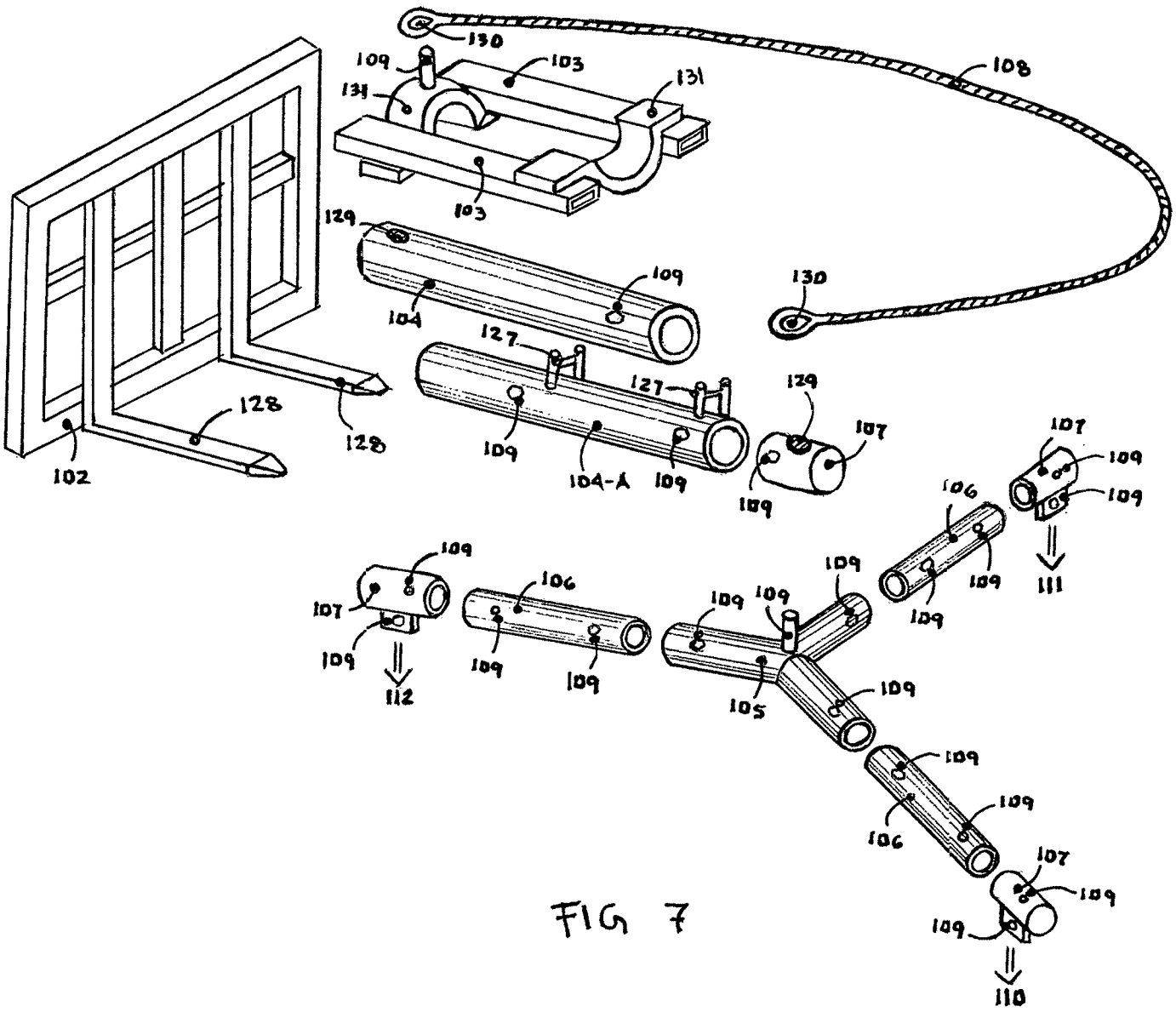

FIG. 7 Exploiting view of Detachable Load Set.

Figure 8:
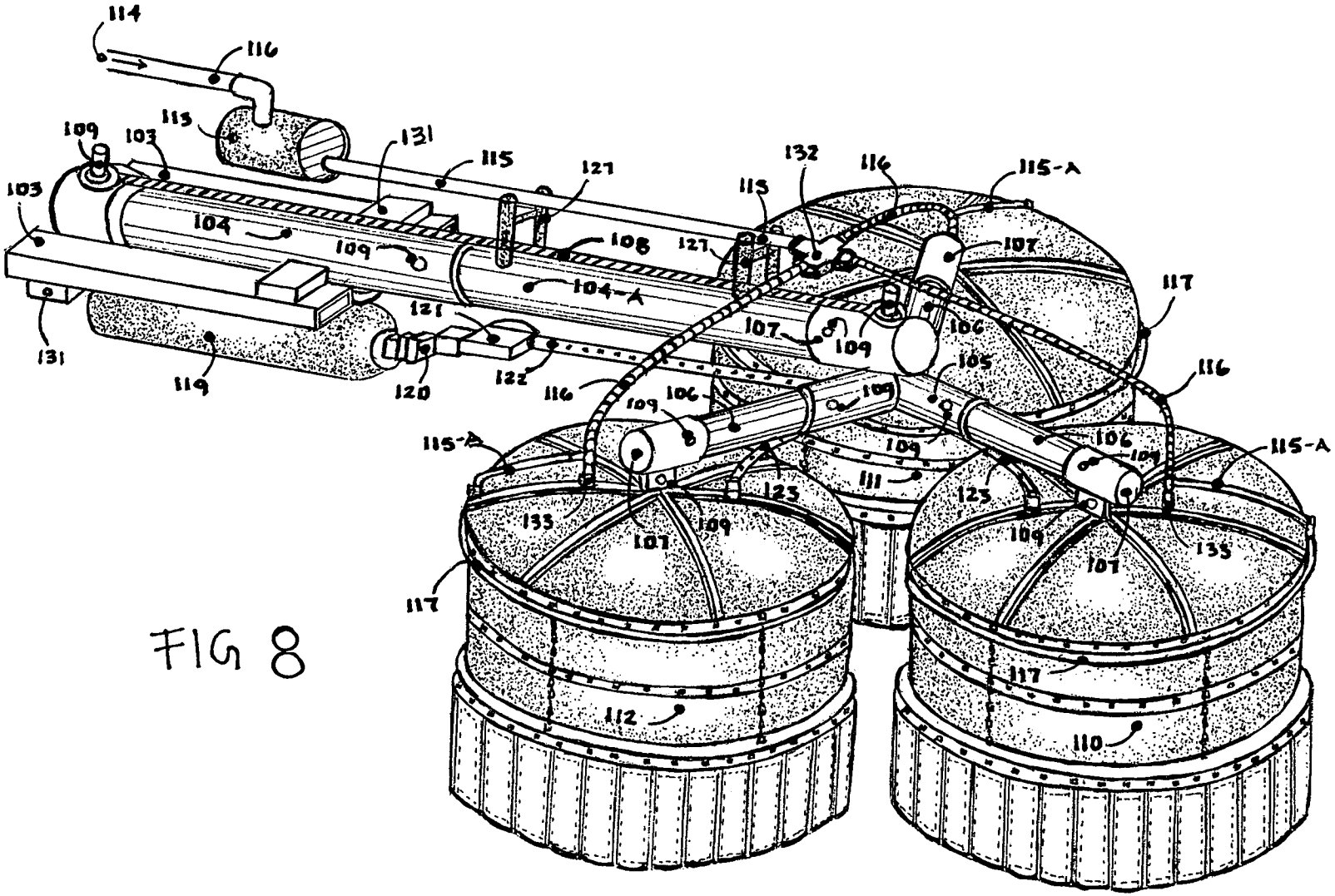

FIG. 8 The Detachable Load Set with the TFI Injectors.

Figure 9:
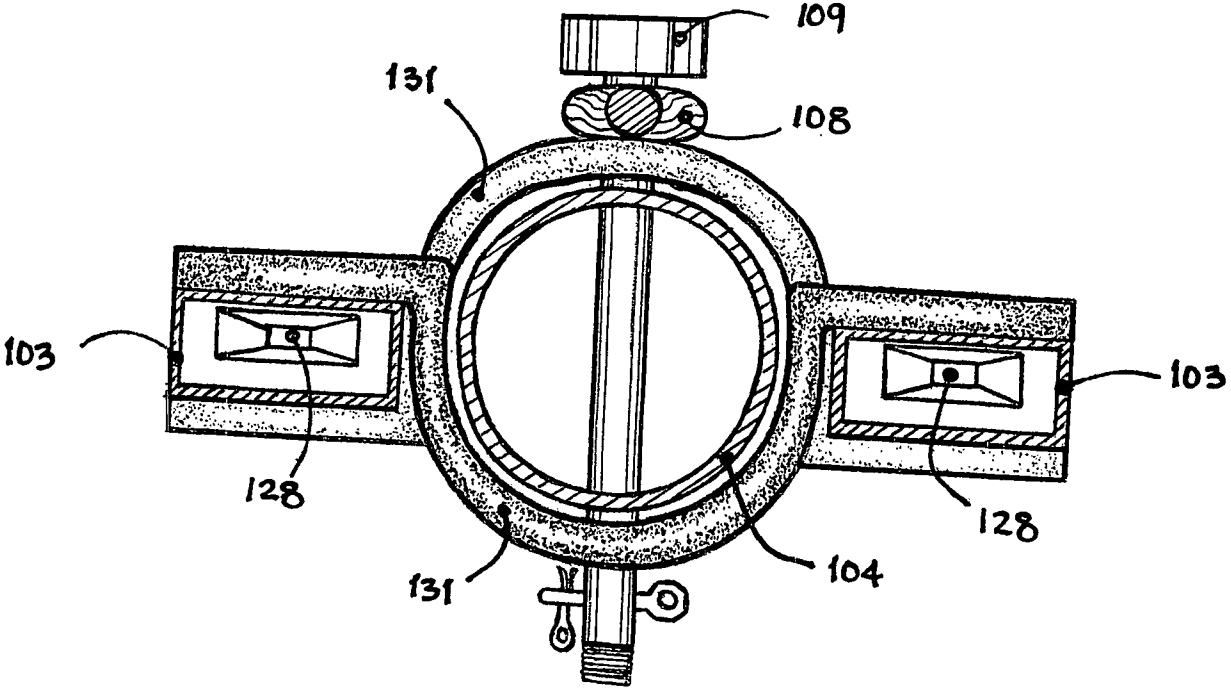

FIG. 9 Front view of the Universal Adapter Hollow Guides

DRAWINGS_REFERENCE NUMERALS

101 Telehandler or Forklift
102 Carriage
103 Embedding Element Hollow Guides
104 Detachable Main Lever
104-A Secondary Detachable Main Lever
105 Injector Holder
106 Detachable Secondary Lever
107 Sustaining Hook
108 Tension Cable
109 Mechanical Pin
110 TFI 1
111 TFI 2
112 TFI 3
113 Fluid Pump
114 Fluid Reservoir
115 Fluid Pipe
115-A A Secondary Metallic Fluid Pipe
116 Flexible Fluid Pipe
117 Sprinklers Metallic Ring
118 Fluid of Fire Extinction
119 CO2 Reservoir
120 Pressure Regulator
121 Electro-Valve
122 Metallic CO2 Pipe
123 Flexible CO2 Pipe
124 CO2
125 Fire
126 Ground
127 Bridge
128 Carriage Guide Forklift Forks
129 Whole
130 Eye
131 U-Shaped Bracket
132 Distributor
133 Flexible Fluid Pipe Entrance
134 Flexible Fluid Pipe Discharge
135 Flexible CO2 Pipe Discharge

DETAILED DESCRIPTION—FIG. 1 THROUGH FIG. 9—PREFERRED EMBODIMENT

The preferred embodiment of the "Multi TFI with fluid sprinklers is composed of 4 main modules:

The first module will be the manipulation and loading. These equipments will be used for the terrestrial operations and will be able to transport the whole system in the areas to fight the fire. FIG. 1 and FIG. 8.

It will basically consist of the Telehandler or Forklift (101) and the Carriage (102), which is the holding element located at the front of the machine and where the Hollow Guides (103), U-Shaped Bracket (131) is mounted and designed to be assembled on to a Telehandler, Tractor or similar.

The second module is the Loading System FIG. 7, FIG. 8 and FIG. 9. It is composed of the Hollow guides (103), which comprises a hollow structure configured to receive said Forklift Forks (128) which will be hinged and fastened to the carriage (102) FIG. 7 and FIG. 9.

Likewise by the Detachable Main Lever (104) and the Secondary Detachable Main Lever (104-A) and will be formed by two or more tubular elements that will be arranged one inside of another and will be fixed between them by means of a Mechanical Pin (109).

The said Detachable Main Lever (104) will be mounted and levered to U-Shaped Bracket (131), welded to the Hollow Guides (103) FIG. 7, FIG. 8 and FIG. 9

The Detachable Main Lever (104), the U-Shaped Bracket (131) and one end of the Tension Cable (108) will be secured by the Mechanical Pin (109) through the eye of the cable (130), the hole (129) and the Detachable Main Lever element (104) FIG. 8 and FIG. 9

At the other end of the Detachable Main Lever (104) will be installed the Secondary Detachable Main Lever (104-A) from which the second end of the Tension Cable (108) will be installed. Likewise, the Sustaining Hook (107), the Injector Holder (105) will be fixed by the Mechanical Pin (109) through the eye (130) of the Sustaining Hook (107) and the Injector Holder (105) through the hole (129) FIG. 8.

The Detachable Secondary Lever (106) will be loaded by the Injector Holder (105) and will be attached to it by Mechanical Pin (109) FIG. 8. At the ends of the Detachable Secondary Lever (106) and the Sustaining Hooks (107) will be attached and fixed by the Mechanical Pin (109), of which the TFIs (110), (111) and (112) will be suspended and secured by Mechanical Pin (109) FIG. 8.

The third module is the "Toxic Fume Injectors" (110), (111) and (112) system disclosed in Potent U.S. Pat. No. 9,174,074 B2. It is composed of a set of Toxic Fume Injector (110), (111) and (112). FIG. 2, FIG. 4, and FIG. 5.

They are suspended from the Sustaining Hook (107) which are placed at one end of the Detachable Secondary Lever (106) and held by the Mechanical Pin (109) FIG. 2, FIG. 4, FIG. 5, FIG. 7 and FIG. 8.

Also, this set of TFI Toxic Fume Injectors (110), (111) and (112) have soldered on the outer perimeter of the upper cover, the Sprinklers metal rings (117) FIG. 2. In addition, the upper caps of the Injectors include a Secondary Metallic Fluid Pipe (115-A) that connects to the Metal Sprinkler Ring (117) and the Flexible Fluid Pipe (116) FIG. 3

In addition, this set of TFI Toxic Fume Injectors (110), (111) and (112) in the top metallic lid, contains the Flexible Fluid Pipes (133) FIG. 2, FIG. 3, FIG. 4 and FIG. 5.

In addition, this set of TFI Toxic Fume Injector devices (110), (111) and (112) have in their upper internal part the discharges of the Flexible Fluid Pipes (134) from which the Fluids of Extinction (118) are discharged FIG. 6, And also the discharges of the Flexible CO2 Pipes (135) from which the CO2 (124) will be discharged, FIG. 6.

The fourth module is the reservoirs and distribution network of fluids and substances.

It is composed of the Fluid Reservoir (114) connected to the Fluid Pump (113) which in turn is connected to the Metal Pipe (115) which is located and is disposed on the top of the Main Lever Detachable (104) and the Secondary Detachable Main Lever (104-A) and which rests on the bridges (127) FIG. 8.

Also one end of the Metal Pipe (115) will be connected to the Distributor (132), from which the Flexible Fluid Pipes (116) will be connected, at the ends of which are installed the Flexible Fluid Pipes (133), where the discharges of the Flexible Fluid Pipes (134) will connect, from where the Fluids of Extinction (118) will be fired into the devices FIG. 6.

In addition to one side of the Flexible Fluid Pipes (133), the Secondary Metal Fluid Pipes (115-A) are connected from which the Metallic Ring Sprinklers (117) are connected, located on the upper caps of TFI devices (110), (111) and (112) and from which the Fluids of Extinction (118) are discharged. FIG. 2, FIG. 3, FIG. 5, FIG. 6 and FIG. 8.

In addition, the CO2 Reservoir (119) is mounted on the bottom of the Hollow Guides (103) FIG. 1 and FIG. 8.

The above-mentioned CO2 Reservoir (119) will immediately connect to a pressure regulator (120) and then an electro valve (121), from which the Metallic CO2 Pipe (122) is connected, from which the Flexible CO2 Pipe will be branched and connected (123) and these will in turn be connected to the discharges of the Flexible CO2 Pipes (135) from which CO2 (124) will be injected into the TFI (110), (111) and (112) FIG. 6.

Operation—FIG. 1 Through FIG. 9

"The Multi TFI with Fluid Sprinklers" will work extinguishing the fire combining a procedure and two basic actions:

Procedure:

The detachable load set (131), (104), (104-A), (105), (106), (107), (108), FIG. 7 and FIG. 9.

This element is designed to be assembled and disarmed in a simple way and by one or two people without using a single tool, using only a few small pins (109) FIG. 7. It is designed in several pieces to be easily manageable and once armed is able to withstand and handle large loads. The first part that is installed is the Hollow Guides (103) sliding it into the Forklift Forks (128) that are installed in the Carriage (102), which is arranged in the Handling Equipment (101) FIG. 1 and FIG. 9

The Detachable Main Lever (104) is then installed, inserting it through the U-Shaped Bracket (131) soldered to the Hollow Guides (103) FIG. 9. Once the Detachable Main Lever (104) is installed, it will form an extraordinary lever with the Embedding Element (103) FIG. 8. With it, we can load and manipulate heavy weight.

Then the Secondary Detachable Main Lever (104-A) is inserted into the Detachable Main Lever (104) and fixed by a Mechanical Pin (109) to lengthen the loading system FIG. 1, FIG. 8. Then, one end of the Tension Cable (108) will be installed on top of one end of the Main Lever Detachable (104) and secured by inserting the Mechanical Pin (109), through the eye (130) of the Tension Cable Eye (108), Through the U-Shaped Bracket (131) and the Hole (129) of the Detachable Main Lever (104) FIG. 7, FIG. 8, FIG. 9.

To complete the assembly of the Detachable Load Lever, consisting of the Hollow Guides (103), the U-Shaped Bracket (131) the Detachable Main Lever (104) and the Secondary Detachable Main Lever (104-A), from which the Injector Holder (105) is hold, held by the Sustaining Hook (107) and fixed by the Mechanical Pin (109). The second end of the Tension Cable (108) will then be installed on the top of the Injector Holder (105), and this will be fixed by a Mechanical Pin (109), which will pass through the Eye (130) of the Tension Cable (108) and the hole (129) of Sustaining Hook (107) FIG. 7 and FIG. 8.

The Detachable Secondary Lever (106) is then inserted into the tips of the Injector Holder (105) and fixed by Mechanical Pin (109). Then the Sustaining Hook (107) will be installed on the ends of the Detachable Secondary Lever (106) and fixed by the Mechanical Pin (109). FIG. 7 and FIG. 8.

This completes the procedure for setting the Detachable Load Set.

Once the mentioned Detachable Load Set is armed, the TFI Toxic Fume Injectors (110), (111) and (112) will be hung at the ends of the Secondary Detachable Lever (106) and supported by the Sustaining Hook (107) and fixed by The Mechanical Pin (109) FIG. 1 and FIG. 8.

The Metallic Fluid Pipe (115) will be connected to the top of the Detachable Main Lever (104) and the Secondary Detachable Main Lever (104-A) and supported on the bridges (127). These Metallic Fluid Pipes (115) will be connected to the Fluid Pump (113) that is connected to the Fluid Reservoir (114). Subsequently, it will be connected to the distributor (132) located at one end of the Metallic Fluid Pipe (115) FIG. 4 and FIG. 5 and from where the Flexible Fluid Pipe (116) will be connected from where the Secondary Metal Fluid Pipe (115-A), which connects the Metallic Ring Sprinklers (117) FIG. 2 and FIG. 3.

In addition to the Flexible Fluid Pipes (116), the Flexible Fluid (133) inputs will be connected, from which the Flexible Fluid Pipe (134) will be connected through which the Fluids (118) will be expelled into the devices and on the flames (125) FIG. 6.

In the same way, the CO2 Reservoir (119) will be installed in the lower part of the Hollow Guides (103) FIG. 1 and FIG. 8, from which the Pressure Regulator (120) will be connected and the Electro-Valve (121), from which the Metallic CO2 Pipe (122) which will be connected to the Flexible CO2 Pipe (123) will be connected and will discharge the CO2 (124) into the devices by means of the discharges of the Flexible CO2 Pipes (135) FIG. 6. Once the Detachable Load Set is installed with the TFI Toxic Fume Injectors (110), (111) and (112), and the hose system for fluid injection is installed, the extinguishing apparatus is ready to exert the first and second action of the invention.

First Action

The Telehandler or Forklift (101) will transport and move the Detachable Load Set, armed with Injectors (110), (111) and (112), FIG. 1 and FIG. 8, through the different areas of fire to be attacked.

By carrying the aforementioned device, the Telehandler or Forklift (101) may be moved to the fire area FIG. 1 and FIG. 4. And by rotating the Carriage (102) upwardly and downwardly it is possible to move the lever formed by the Detachable Main Lever (104) and the Secondary Detachable Main Lever (104-A) from which the Injector Holder (105) is engaged and This in turn forms a small network of levers with the Detachable Secondary Lever (106), of which the TFI "Toxic Fume Injectors" (110), (111) and (112) hang, supported by the Sustaining Hook (107) FIG. 1, FIG. 2, FIG. 4, FIG. 5, FIG. 8.

With this, Telehandler or Forklift (101) can introduce the TFI "Toxic Fume Injectors" (110), (111) and (112) directly into the fire and by collapsing it stops the combustion process simultaneously injecting toxic fumes generated from the same combustion FIG. 5.

After a few seconds all the fire trapped under the tarps of the mentioned Injectors is very reduced or extinct, but although this happens the temperature and heat that remains inside and outside of the TFI devices are still very high, and it happens that at Lift the Injectors to continue the attacks, the fire tends to restart in some occasions and is why a second action will be exerted to avoid re-ignition of the fire.

Second Action

As mentioned above even if the fire has already been reduced or extinct, the heat as well as the temperatures inside and outside the devices remain very high, so when lifting TFI devices from the attacked area, heat transfer From the exterior to the interior, as well as from the interior to the exterior flows automatically, forming a thermal transfer bridge and this is the reason why in some occasions the fire ignition happens.

In order to avoid this physical chemical phenomenon, a second action will be implemented in the final fire extinction process. This consists of the injection of fluids of extinction and substances on the area that is covered with the TFI devices, as well as the perimeter thereof.

Therefore, when compressing the fire by depositing the TFI injectors mentioned above on the latter, they will compress the flames and stop the combustion process, so that the fire is reduced to a minimum or eliminated, after a few seconds the operator of the Telehandler or Forklift (101), will activate a switch that will turn on the Fluid Pump (113) and begin to extract fluids and substances contained in the Fluid Reservoir (114) and transport them through the pipe network, formed by the Metallic Fluid Pipe (115) The distributor (132), the Flexible Fluid Pipe (116), the Secondary Metallic Fluid Pipe (115-A), the Metallic Ring Sprinklers (117) that trigger the Fluids of Extinction (118) to the outside of the TFI FIG. 2, FIG. 3, FIG. 5 and FIG. 6, these same fluids will travel to the inflow of the Flexible Fluid Pipes (133) and finally to the discharges of the Flexible Fluid Pipes (134), which will discharge the Fluids of Extinction (118) To the inside of the devices TFI FIG. 6.

Almost simultaneously the Telehandler or Forklift operator (101) will activate a second switch that activates the Electro-Valve (121), which will allow extracting a certain amount of CO2, contained in the CO2 Reservoir (119) and regulating the pressure required with The pressure Regulator (120). This pressure will be determined by the type and size of the fire to be extinguished. The aforementioned CO2 will be transported to the interiors of the TFI devices (110), (111) and (112) through the network of pipes formed by the Metallic CO2 Pipe (122) the Flexible CO2 Pipe (123), up to arrive at the discharges of the Flexible CO2 Pipe (135) by which the CO2 (124) will be expelled into the TFI devices, FIG. 6, this to avoid the activity of any small flame that would remain active inside said devices.

After a few seconds the operator will close both switches, deactivating both injection systems, so that the quantities of fluids and substances discharged on the fire will be really small and will not require large quantities of the fluids mentioned above, since those that control, reduce and eliminate the fire are TFI Injectors, so the injection of fluids only serves to cool the areas of fire attacked and break with the heat transfer bridges when lifting TFI injectors from the fire, to continue with the next area to attack.

Resume:

The present invention is a fire extinguisher that is composed by a detachable lever network that is built in to a loading equipment. From such lever network, a plurality of devices will remain suspended, being directly introduced to the fire to stop the combustion process.

Simultaneously, a fluid injection will be performed over the fire area that was attacked to cool the surface, which will prevent a possible reignition of the flames that were previously attacked. Such fluid injection will be performed by a pipeline network that will be supported over and through the lever network previously mentioned.

I claim:

1. A fire extinguisher system that comprises a network of metallic pipes of different diameters and sizes, one of the metallic pipes inside another, locked through metallic pins, which together form a main lever; a distal end of said main lever supports a set of smaller pipes designed to carry at least one Toxic Fume Injector; the at least one Toxic Fume Injector includes an upper metallic circular frame that attaches a flexible chamber, which is composed of a set of flexible canvases; a proximal end of the said main lever is inserted in an embedding element, the embedding element is configured to be mounted and installed on a Telehandler or Forklift, wherein the embedding element includes a pair of hollow guides that house a pair of telehandler or forklift forks, an upward facing U-shaped bracket and a downward facing U-shaped bracket, wherein the U-shaped brackets are attached to said pair hollow guides and together from a housing for said main lever; thus, the embedding element creates a junction between the said main lever and the telehandler or forklift; wherein a tension cable is installed and attached between edges of the said main lever to prevent arching of the main lever when handling the at least one Toxic Fume Injector.

2. The fire extinguisher system as described on claim 1, further holds a network of fluid pipes used to transport a firefighting fluid from a reservoir located away from the at least one Toxic Fume Injector to an interior and an exterior of the at least one Toxic Fume Injector; thus, the fire extinguisher system suffocates a fire, as well as, sprays said firefighting fluid to the fire, thereby, getting rid of heat and oxygen, forming an enhanced fire fighting system.

* * * * *